US010399360B2

(12) United States Patent
Schütz

(10) Patent No.: US 10,399,360 B2
(45) Date of Patent: Sep. 3, 2019

(54) APPARATUS FOR PRODUCING SELF-ADHESIVE LABELS

(71) Applicant: CEWE Stiftung & Co. KGaA, Oldenburg (DE)

(72) Inventor: Peter Schütz, Varel (DE)

(73) Assignee: CEWE Stiftung & Co. KGaA, Oldenburg (DE)

( * ) Notice: Subject to any disclaimer, the term of this patent is extended or adjusted under 35 U.S.C. 154(b) by 0 days.

(21) Appl. No.: 15/741,279

(22) PCT Filed: Jul. 15, 2016

(86) PCT No.: PCT/EP2016/066982
§ 371 (c)(1),
(2) Date: Dec. 31, 2017

(87) PCT Pub. No.: WO2017/013040
PCT Pub. Date: Jan. 26, 2017

(65) Prior Publication Data

US 2018/0207953 A1 Jul. 26, 2018

(30) Foreign Application Priority Data

Jul. 17, 2015 (DE) ..... 10 2015 213 544
Jun. 28, 2016 (DE) ..... 20 2016 103 433 U

(51) Int. Cl.
*B41J 3/407* (2006.01)
*B26D 3/08* (2006.01)
(Continued)

(52) U.S. Cl.
CPC ..... *B41J 3/4075* (2013.01); *B26D 3/085* (2013.01); *B26D 5/32* (2013.01); *B26D 5/34* (2013.01);
(Continued)

(58) Field of Classification Search
CPC .... B31D 1/027; B31D 1/026; B31D 2201/02; B26D 3/085; B26D 5/32; B26D 5/34;
(Continued)

(56) References Cited

U.S. PATENT DOCUMENTS 5,481,291 A * 1/1996 Ishida ..... B41J 17/12 347/217
6,106,176 A * 8/2000 Yanagisawa ..... B41J 3/4075 400/279

FOREIGN PATENT DOCUMENTS

EP 2 361 737 8/2011
JP 2001-009934 1/2001
(Continued)

OTHER PUBLICATIONS

International Search Report and Written Opinion of the International Searching Authority in International Patent Application No. PCT/EP2016/066982 (+ English translation), 20 pages.

*Primary Examiner* — Huan H Tran
*Assistant Examiner* — Alexander D Shenderov
(74) *Attorney, Agent, or Firm* — Ellen M. Bierman; Lowe Graham Jones PLLC

(57) ABSTRACT

An apparatus and method for producing self-adhesive labels, in particular in a self-service area, for example of a drug store, is provided. The apparatus comprises a dye-sublimation thermal printer, as a printing means for printing a printing pattern onto an adhesive film, and a cutting apparatus for cutting the adhesive film along a cutting pattern, the adhesive film being moved automatically from the printing means to the cutting apparatus. Initially, only a first moving unit of the printing means moves the adhesive film at a first speed to a second moving unit of the cutting apparatus, after which both moving units move the printed adhesive film further in the forward direction.

14 Claims, 5 Drawing Sheets

(51) Int. Cl.

| | |
|---|---|
| ***B26D 5/32*** | (2006.01) |
| ***B26D 5/34*** | (2006.01) |
| ***B26D 7/27*** | (2006.01) |
| ***B26F 1/38*** | (2006.01) |
| ***B31D 1/02*** | (2006.01) |
| ***B41J 11/70*** | (2006.01) |
| ***B41J 2/325*** | (2006.01) |
| ***B65H 20/02*** | (2006.01) |
| ***B65H 35/06*** | (2006.01) |
| *B26D 7/00* | (2006.01) |

(52) U.S. Cl.

CPC ..... *B26D 7/27* (2013.01); *B26F 1/3813* (2013.01); *B31D 1/026* (2013.01); *B31D 1/027* (2013.01); *B41J 2/325* (2013.01); *B41J 11/70* (2013.01); *B41J 11/703* (2013.01); *B65H 20/02* (2013.01); *B65H 35/06* (2013.01); *B26D 2007/005* (2013.01); *B31D 2201/02* (2013.01); *B65H 2301/5151* (2013.01); *B65H 2301/5154* (2013.01); *B65H 2404/143* (2013.01); *B65H 2513/108* (2013.01); *B65H 2553/21* (2013.01); *B65H 2553/22* (2013.01); *B65H 2553/25* (2013.01); *B65H 2701/1311* (2013.01); *B65H 2701/192* (2013.01); *B65H 2801/12* (2013.01)

(58) Field of Classification Search

CPC ... B26D 7/27; B26D 2007/005; B26F 1/3813; B41J 3/4075; B41J 11/70; B41J 2/325; B65H 20/02; B65H 2701/1311; B65H 2301/5151; B65H 2301/5154; B65H 2513/108; B65H 2801/12; B65H 2553/21; B65H 2553/22; B65H 2553/25; B65H 2404/143; B65H 2701/192

USPC ..... 347/218

See application file for complete search history.

(56) References Cited

FOREIGN PATENT DOCUMENTS

| | | |
|---|---|---|
| JP | 2009-006594 | 1/2009 |
| JP | 2013-180359 | 9/2013 |

* cited by examiner

APPARATUS FOR PRODUCING SELF-ADHESIVE LABELS

CROSS-REFERENCE TO RELATED APPLICATIONS

This application is a U.S. national phase of International Patent Application No. PCT/EP2016/066982 filed Jul. 15, 2016; which claims priority from German Patent Application Nos. 202016103433.7 filed Jun. 28, 2016 and 102015213544.6 filed Jul. 17, 2015, which applications are incorporated herein by reference in their entireties.

TECHNICAL FIELD

The invention relates to an apparatus, a method and a computer program for producing self-adhesive labels by means of a thermal dye-sublimation process. The invention also relates to a printing means for printing a pattern onto an adhesive film by means of a thermal dye-sublimation process and a cutting apparatus for cutting the adhesive film along a cutting pattern.

BACKGROUND

Nowadays, a user can select a product on the Internet, for example a shower gel or a sun cream, and design a pattern to be applied to the product in order to personalize it. The selected product is sent together with the designed pattern to a printing works, where the pattern designed by the user is printed onto an adhesive film. A printing works employee removes the printed adhesive film from the printing means and places it into a cutting apparatus. The employee also aligns the printed adhesive film in the cutting apparatus before the cutting apparatus cuts along the outline of the printed pattern to produce an adhesive label. The employee then sticks the label thus produced onto the selected products, after which the selected product is sent to the user by post.

The adhesive labels may have cutting errors, which are due, in particular, to the required adjustment by the employee, as a result of which the quality of the label may be reduced.

BRIEF DESCRIPTION OF THE DRAWINGS

Example embodiments of the invention shall now be described with reference to the attached Figures, in which.

DETAILED DESCRIPTION

Figure 1:
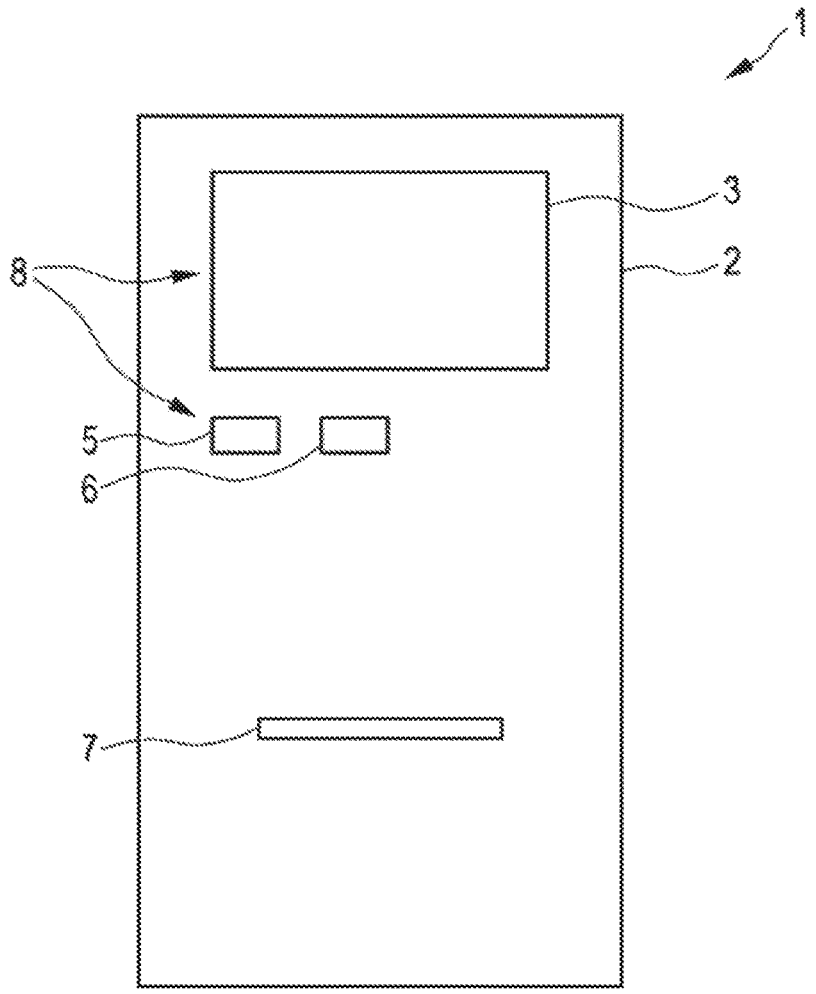
FIG. 1 shows, in schematic form and by way of example, an embodiment of an apparatus for producing self-adhesive labels.

Current adhesive label cutting procedures may result in cutting errors, which are due, in particular, to the required adjustment by the employee, as a result of which the quality of the label may be reduced.

The present disclosure provides an apparatus, a method and a computer program for producing self-adhesive labels, which can improve the quality of the adhesive labels thus produced.

This is achieved by an apparatus for producing self-adhesive labels, in particular in a self-service area, for example of a drug store, by means of a thermal dye-sublimation process, said device comprising:

- a printing means for printing a printing pattern onto an adhesive film by means of a thermal dye-sublimation process, and
- a cutting apparatus for cutting the adhesive film along a cutting pattern, said printing means having a first moving unit for moving the printed adhesive film from the printing means to the cutting apparatus in a first direction and the cutting apparatus has a second moving unit for moving the printed adhesive film in the first direction inside the cutting apparatus, said printing means and said cutting apparatus being configured such that only the first moving unit moves the printed adhesive film initially at a first speed to the second moving unit, after which both moving units move the printed adhesive film at a second speed in the first direction again.

The apparatus thus comprises a printing means and a cutting apparatus, wherein said printing means prints the adhesive film, after which only the first moving unit initially moves the printed adhesive film at a first speed to the second moving unit, before both moving units then move the printed adhesive film at a second speed in the first direction again. The orientation of the adhesive film inside the cutting apparatus is known, due to the printed adhesive film being transferred automatically from the printing means to the cutting apparatus, thus obviating the need to manually adjust the adhesive film inside the cutting apparatus. This can result in a reduced susceptibility to error, that is, in less likelihood of inaccurate cuts, and thus in adhesive labels of better quality. Since there is also direct transfer from the printing means to the cutting apparatus, with no need for a transferring apparatus disposed therebetween, for example, the amount of space required by the apparatus can be relatively small. The printing means and the cutting apparatus are typically configured in such a way, therefore, that the printed adhesive film is transferred directly from the printing means to the cutting apparatus, in particular with no need for a transferring apparatus arranged between the printing means and the cutting apparatus.

The printing means and the cutting apparatus are typically configured by configuring one or more respective controllers. For example, local controllers of the printing means and the cutting apparatus, as well as a central controller which communicates with the local controllers, may be configured to control and thus to configure the printing means and the cutting apparatus in such a way that only the first moving unit moves the printed adhesive film initially at a first speed to the second moving unit, after which both moving units move the printed adhesive film at a second speed in the first direction again. Other components of the apparatus, such as detection units, release units, etc., are also configured typically by configuring one or more controllers which control those components.

The apparatus may also have an input device which is adapted to allow a user to enter inputs, and a pattern generating means for generating a pattern on the basis of said user inputs, wherein the pattern comprises a cutting pattern and a printing pattern inside the cutting pattern.

The input device, the pattern generating means, the printing means and the cutting apparatus are typically integrated in the same apparatus for producing self-adhesive labels. The user can therefore input data directly in a self-service area of a drug store, for example, after which the pattern generating means generates the pattern on the basis of the user inputs, the printing means prints the generated pattern onto the adhesive film, the printed adhesive film is guided directly and automatically to the cutting apparatus and the cutting apparatus cuts the adhesive film along the cutting pattern to produce the adhesive label directly in the self-service area. The apparatus can therefore produce a personalized adhesive label in a relatively fast process using user inputs.

The first direction, which could be referred to as the forward direction, is the direction from the printing means to the cutting apparatus. The printing means and the cutting apparatus are typically arranged in such a way that the adhesive film can be moved linearly in a forward direction from the printing means to the cutting apparatus via the transferring apparatus, the first and the second moving units being adapted to move the printed adhesive film in a forward direction by performing a translational movement only, without rotating the adhesive film. Since the first and the second moving units move the printed adhesive film by performing a translational movement only, without rotating the adhesive film, the likelihood of incorrect adjustment of the printed adhesive film within the cutting apparatus and therefore of inaccurate cuts is further reduced. In order to further improve this cutting accuracy, the pattern generating means may be adapted to mark the pattern with an orientation marking so that the printed adhesive film has an orientation marking, the cutting apparatus having a detection unit for detecting the orientation marking on the printed adhesive film, and may be adapted to optimize the orientation of the printed adhesive film inside the cutting apparatus, on the basis of the detected orientation marking, before cutting is carried out. In particular, the second moving unit of the cutting apparatus for moving the printed adhesive film inside the cutting apparatus in a forward and a backward direction, and a cutting unit of the cutting apparatus, which can be moved laterally in relation thereto and in particular orthogonally in relation thereto, can be controlled in such a way that, before cutting is carried out, the position of the cutting unit relative to the orientation marking corresponds even better to a predefined position. In this way, the cutting accuracy can be further improved. The orientation marking typically has an L-shaped structure which is typically arranged in a corner area of the printed adhesive film, although the orientation marking may also have a different structure, of course. The detection unit may have a light source, in particular a laser, for irradiating the printed adhesive film, and a detector for detecting the light reflected from the printed adhesive film, wherein the detection unit may be designed to detect the orientation marking on the basis of the reflected light, and wherein the cutting apparatus may be configured not to activate the laser until the second moving unit is activated. In this way, the energy consumption of the apparatus can be reduced.

Due to the printed adhesive film being fed automatically and relatively accurately from the printing means to the cutting apparatus, automatic repositioning based on a plurality of orientation markings on the printed adhesive film does not generally provide any further advantage as far as accuracy is concerned. In one embodiment, such repositioning is therefore carried out purely on the basis of a single orientation marking. Several orientation markings could be used in other embodiments, however. In one embodiment, repositioning could also be omitted, in which case the printed adhesive film could have no orientation marking. The cutting apparatus then has typically no detection unit for detecting an orientation marking on the printed adhesive film, which would be suitable for relative positioning of the printed adhesive film and a cutting unit of the cutting apparatus, and the printing means is typically configured not to print such an orientation marking onto the adhesive film.

The second moving unit and the cutting unit are typically configured such that the printed adhesive film and the cutting unit are moved in such a way that the adhesive film is cut along the generated cutting pattern.

The printing means and the cutting apparatus are typically configured such that the first speed and the second speed are different. More specifically, the first speed is greater than the second speed. In one example embodiment, the first moving unit has a maximum speed and the first speed is said maximum speed. This allows very fast and automatic transfer of the printed adhesive film from the printing means to the cutting apparatus, the printed adhesive film being initially moved with a maximum possible first speed to the second moving unit of the cutting apparatus, after which the first moving unit and the second moving unit jointly move the printed adhesive film further into the cutting apparatus. The second speed can be defined as the lower of the two maximum speeds of the first moving unit and the second moving unit. In another embodiment, the first speed and the second speed can also be equal.

The printing means and the cutting apparatus are preferably adapted such that only the first moving unit is initially activated to move the printed adhesive film to the second moving unit, with both moving units then being activated such that the two moving units synchronously move the printed adhesive film further into the cutting apparatus. More particularly, the printed adhesive film is moved to a short distance in front of the second moving unit, and it is not until then that the two moving units are moved synchronously in order to guide the printed adhesive film into the cutting apparatus. Due to the first moving unit initially moving the printed adhesive film to a short distance in front of the second moving unit, and to the fact that it is not until that state has been reached, in which the printed adhesive film is located a short distance in front of the moving unit, that both the moving units are moved synchronously to guide the printed adhesive film into the cutting apparatus, it is possible to prevent the first moving unit from pressing the printed adhesive film against the second moving unit, as a result of which it is possible to prevent the printed adhesive film from being curled, folded and/or twisted. Since the second moving unit is also activated only when the state described above has been reached, in which the printed adhesive film is located directly in front of the second moving unit, the second moving unit is not activated unnecessarily, with the result that energy consumption can be reduced.

In one example embodiment, the printing means has a roll of adhesive film comprising the adhesive film and a cut-off unit for cutting the printed adhesive film so as to detach the printed adhesive film from the roll of adhesive film, said printing means being configured such that, after the printed adhesive film has been moved in the first direction to the second printing means by the first printing means, after the second moving unit has gripped the printed adhesive film for further movement, the printed adhesive film is cut off by means of the cut-off unit. This means that, at the moment the printed adhesive film is cut off, it is held not only by the printing means, in particular by the first moving unit of the printing means, but also by the second moving unit of the cutting apparatus, with the result that it is very unlikely that the printed adhesive film is moved by the cutting operation. This can result in a further improvement in the precision with which the printed adhesive film is oriented inside the cutting apparatus and thus in the cutting operation being performed with even greater precision along the cutting pattern.

The second moving unit typically comprises motor-driven rolls for moving the printed adhesive film into the cutting apparatus, said motor-driven rolls having no freewheel. By using these rolls with no freewheel, the printed adhesive film can be held even more securely, particularly when the printed adhesive film is being cut off by means of the cut-off unit of the printing means. This can result in a further improvement in the precision with which the printed adhesive film is oriented inside the cutting apparatus and thus in the cutting operation being performed with even greater precision along the cutting pattern.

The cutting apparatus typically has a guide structure between the second moving unit and the printing means, for guiding the printed adhesive film from the printing means to the second moving unit, said guide structure having at least two converging surfaces. In one example embodiment, the guide structure is funnel-shaped. The guide structure can ensure, for example, that the adhesive film is fed to the cutting apparatus even when the adhesive film is curled. Such paper curl of the printed adhesive film can occur when the adhesive film has been rolled off a roll of adhesive film. The guide structure may also allow the cutting apparatus to be combined with different printing means in which the respective output areas have different heights. Even when the output area of the printing means and an input area of the cutting apparatus are positioned at different heights, the printed adhesive film can still be transferred by means of the guide structure from the printing means to the cutting apparatus.

In one embodiment, the apparatus has a guide mechanism for guiding a relative movement between the printing means and the cutting apparatus along the first direction. The apparatus also has a detection unit which is designed to detect whether the printing means and the cutting apparatus have a predefined position relative to one another. In particular, the printing means and the cutting apparatus are configured such that an adhesive film is only printed and moved in the first direction from the printing means to the cutting apparatus when the detection unit has detected that the printing means and the cutting apparatus are spaced apart by the predefined amount.

This means that the cutting apparatus and the printing means can be moved relatively to each other in the direction in which the printed adhesive film is moved from the printing means to the cutting apparatus, guided by the guide mechanism, the guide mechanism typically being a rail guide mechanism. This allows the cutting apparatus and the printing means to be separated from each other and to be subsequently joined together again. It may make sense to separate them in order to improve access to the cutting apparatus and/or the printing means, for example to carry out maintenance work, in particular to replace a roll of adhesive film or an ink ribbon roll.

The detection unit for detecting whether the printing means and the cutting apparatus have a predefined position relative to each other in the first direction can be a simple touch sensor, for example, which is arranged on the cutting apparatus or on the printing means and detects whether a part of the respective other device is touched. The apparatus preferably works only when the detection unit has established that cutting apparatus and the printing means are correctly positioned relative to each other.

The printing means can be controlled in such a way that the first moving unit moves the printed adhesive film a predefined distance in the first direction at the first speed, the predefined distance being selected such that the printed adhesive film is positioned directly in front of the second moving unit after said movement. The second moving unit is then activated, after which the two moving units move the printed adhesive film in the first direction. In this case in particular, the work performed by the device can result in the printed adhesive film being oriented with improved precision inside the cutting apparatus only on condition that the detection unit has established that the cutting apparatus and the printing means are correctly positioned relative to each other.

In one example embodiment, the cutting apparatus has a release unit for releasing the printed and cut adhesive film from the cutting apparatus. When the adhesive film is being cut along the cutting pattern inside the cutting apparatus, the printed adhesive film is generally moved back and forth several times, in the first direction at least, which can cause the printed adhesive film to become electrostatically charged. This can make it more difficult to release the printed adhesive film from the cutting apparatus, in particular from an output area of the cutting apparatus, because the printed and cut adhesive film can stick to the cutting apparatus. In order that the printed and cut adhesive film can nevertheless be easily released, the cutting apparatus may have a release unit for releasing the printed and cut adhesive film from the cutting apparatus. This release unit can take the form of a magnetic poppet valve, for example, which has an element which can lift the printed and cut adhesive film from a surface in the output area of the cutting apparatus. The release unit may also take a different form, for example it may have motor-driven rolls which can detect a portion of the printed and cut adhesive film overlaying a surface in the output area of the cutting apparatus, then pull it down from the surface.

The printing pattern is typically a color and/or black and white and/or grayscale pattern. The input device typically comprises a photo data receiving unit, said photo data receiving unit being adapted to receive the user's photo data as user input. The input device is typically also adapted to show the user different pattern templates and to allow the user to select a pattern template as user input. The input device is typically also adapted to allow a user to select a product, in particular a product bought in a self-service area of a drug store, wherein the input device can be further adapted to select a pattern template on the basis of the selected product and on the basis of predefined allocations between products and patterns, and to provide the selected pattern template as user input. More particularly, the products may be marked with a product code, and the input device may comprise a product code reader for reading a product code of a product selected by the user. The product code can be a barcode, for example, and the product code reader can be a unit for reading a barcode. The input device can also be adapted to allow the user to enter inputs which modify the selected pattern template, for example the user can enter a text and/or a color to be added to the pattern. The photo data can also be added to the pattern.

Producing improved quality of the adhesive labels is also achieved by a printing means for printing a printing pattern onto an adhesive film by means of a thermal dye-sublimation process, said printing means being designed to be operated together with a cutting apparatus to produce adhesive labels, in particular in a self-service area, for example of a drug store, said printing means having a first moving unit for moving the printed adhesive film from the printing means to the cutting apparatus in a first direction and the cutting apparatus has a second moving unit for moving the printed adhesive film in the first direction inside the cutting apparatus, said printing means being adapted to firstly move the printed adhesive film only by means of the first moving unit at a first speed to the second moving unit and then to move the printed adhesive film into the cutting apparatus at a second speed in the first direction by means of the first moving unit acting jointly with the second moving unit.

Producing improved quality of the adhesive labels is also achieved by a cutting apparatus for cutting an adhesive film along a cutting pattern, said cutting apparatus being designed to be operated together with a printing means to produce adhesive labels by means of a thermal dye-sublimation process, in particular in a self-service area, for example of a drug store, said printing means having a first moving unit for moving the printed adhesive film from the printing means to the cutting apparatus in a first direction and the cutting apparatus has a second moving unit for moving the printed adhesive film in the first direction inside the cutting apparatus, said cutting apparatus being configured to move the printed adhesive film into the cutting apparatus at a second speed in the first direction by means of the second moving unit acting jointly with the first moving unit, after only the first moving unit has moved the printed adhesive film initially at a first speed in the first direction to the second moving unit.

Producing improved quality of the adhesive labels is also achieved by a method for producing adhesive labels by means of a thermal dye-sublimation process, in particular in a self-service area, for example of a drug store, said method comprising the steps of:

- printing the printing pattern onto an adhesive film by means of a printing means using a thermal dye-sublimation process,
- automatically moving the printed adhesive film from the printing means to the cutting apparatus in a first direction by means of a first moving unit of the printing means and automatically moving the printed adhesive film in the first direction inside the cutting apparatus by means of a second moving unit of the cutting apparatus, wherein only the first moving unit moves the printed adhesive film initially at a first speed to the second moving unit, after which both moving units move the printed adhesive film at a second speed in the first direction again, and
- cutting the adhesive film along a cutting pattern by means of the cutting apparatus.

The method may include additional steps, for example allowing the user to enter inputs using an input device, or generating a pattern by means of a pattern generating means on the basis of the user inputs, said pattern comprising a cutting pattern and a printing pattern within the cutting pattern.

Producing improved quality of the adhesive labels is also achieved by a computer program or instructions for producing adhesive labels, said computer program stored in a computer-readable medium and containing program code which is designed to control an apparatus for producing self-adhesive labels in such a way that the method for producing adhesive labels is carried out when the computer program is executed on a controller which controls the apparatus.

It should be understood that the apparatus, the printing means, the cutting apparatus, the method and the computer program have similar and/or identical embodiments.

Figure 2:
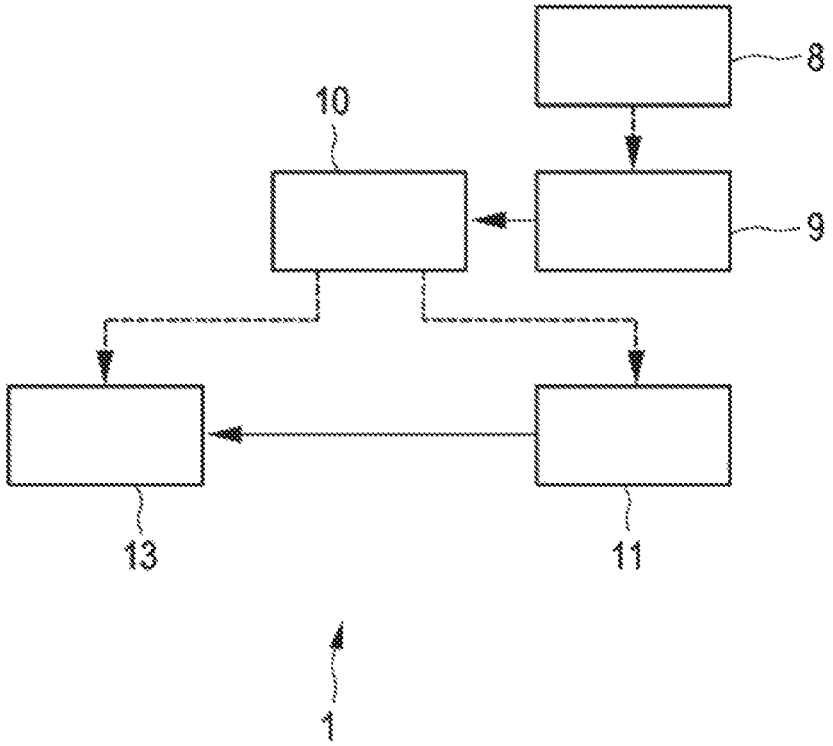
FIG. 2 shows, in schematic form and by way of example, some components of the apparatus shown in FIG. 1.
Figure 3:
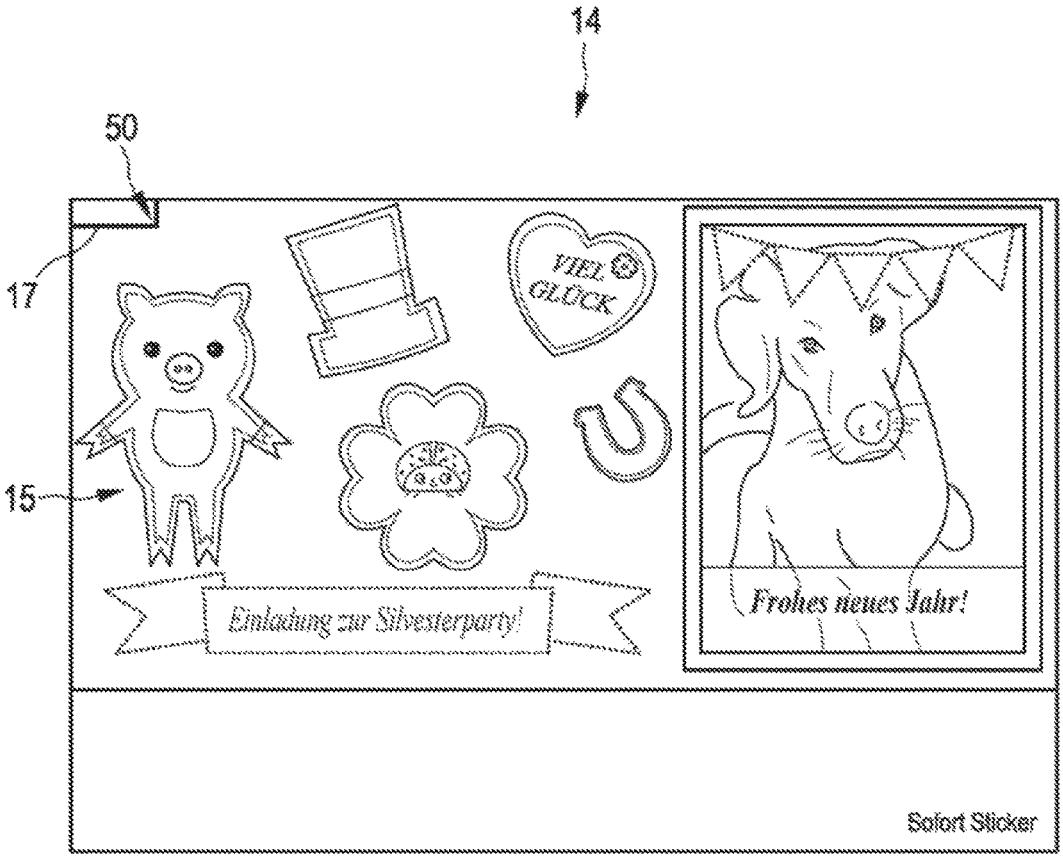
FIG. 3 shows, in schematic form and by way of example, a printed and cut adhesive film containing several adhesive labels thus produced.

FIG. 1 shows, in schematic form and by way of example, an embodiment of an apparatus for producing self-adhesive labels. In this example, apparatus 1 is in a self-service area of a drug store. Apparatus 1 comprises a touch-sensitive monitor 3, a photo data receiving unit 5 and a product code reader 6 in a housing 2. Touch-sensitive monitor 3, photo data receiving unit 5 and product code reader 6 may be conceived of as components of an input device 8 which is adapted to allow a user to enter inputs. Inside housing 2, there is also a pattern generating means 9 for generating a pattern 15 on the basis of the user inputs, pattern 15 comprising a cutting pattern and a printing pattern within the cutting pattern, FIG. 2 illustrates, in schematic form and by way of example, the pattern generating means 9 and other components of apparatus 1 that are located inside housing 2. FIG. 3 shows an example of a printed and cut adhesive film 14 containing several patterns 15.

Photo data receiving unit 5 is adapted to receive the user's photo data as user inputs. The user can also select a product that is obtainable in the self-service area of the drug store and hold it up to product code reader 6 so that a product code applied to the product can be read by product code reader 6. The product code can be a barcode, for example, and product code reader 6 can be a unit for reading a barcode. Input device 8 can also have allocations between products or product codes, on the one hand, and pattern templates, on the other hand, and one or more pattern templates can be shown on touch-sensitive monitor 3 on the basis of these allocations and the product code which is read from the product selected by the user. When several pattern templates are displayed on touch-sensitive monitor 3, the user can select one of them. Input device 8 can also be adapted to allow the user to enter desired changes, for example a desired text, a desired color, etc. On the basis of those user inputs, pattern generating means 9 can generate the pattern.

Apparatus 1 further comprises printing means 11 for printing the printing pattern onto an adhesive film 14, and a cutting apparatus 13 for cutting the adhesive film 14 along the cutting pattern. Printing means 11 and cutting apparatus 13 are configured to allow automatic, direct transmission of printed adhesive film 14 from printing means 11 to cutting apparatus 13 without requiring a transferring apparatus arranged between printing means 11 and cutting apparatus 13. Printing means 11 comprises a first moving unit for automatically moving printed adhesive film 14 in a forward direction from printing means 11 to cutting apparatus 13. Apparatus 1 further comprises a controller 10 which is configured to control the automatic transfer of printed printing substrate 14 from printing means 11 to cutting apparatus 13.

The printing pattern is typically a color and/or black and white and/or grayscale pattern. Printing means 11 is a dye-sublimation thermal printer. Dye-sublimation thermal printer 11 is typically adapted to print the printing pattern onto a printed area of a web of adhesive film, to feed the printed region of the web of adhesive film, i.e. the printed adhesive film, to cutting apparatus 13 and then to cut off the printed adhesive film. Printed adhesive film 14 is therefore the same as the respective printed area on the adhesive film.

Dye-sublimation thermal printer 11 is the Citizen CX printer or DS40 printer, for example, or some other dye-sublimation thermal printer.

Printing means 11 and cutting apparatus 13 are arranged in such a way that adhesive film 14 can be moved linearly in a forward direction from printing means 11 to cutting apparatus 13, the first moving unit of printing means 13 and a second moving unit of cutting apparatus 13 being adapted to move printed adhesive film 14 in a forward direction by performing a translational movement only, without rotating adhesive film 14. The adhesive film 14 printed upon by printing means 11 and cut by cutting apparatus 13 is then guided out of housing 2 through an output slot 7.

Figure 4:
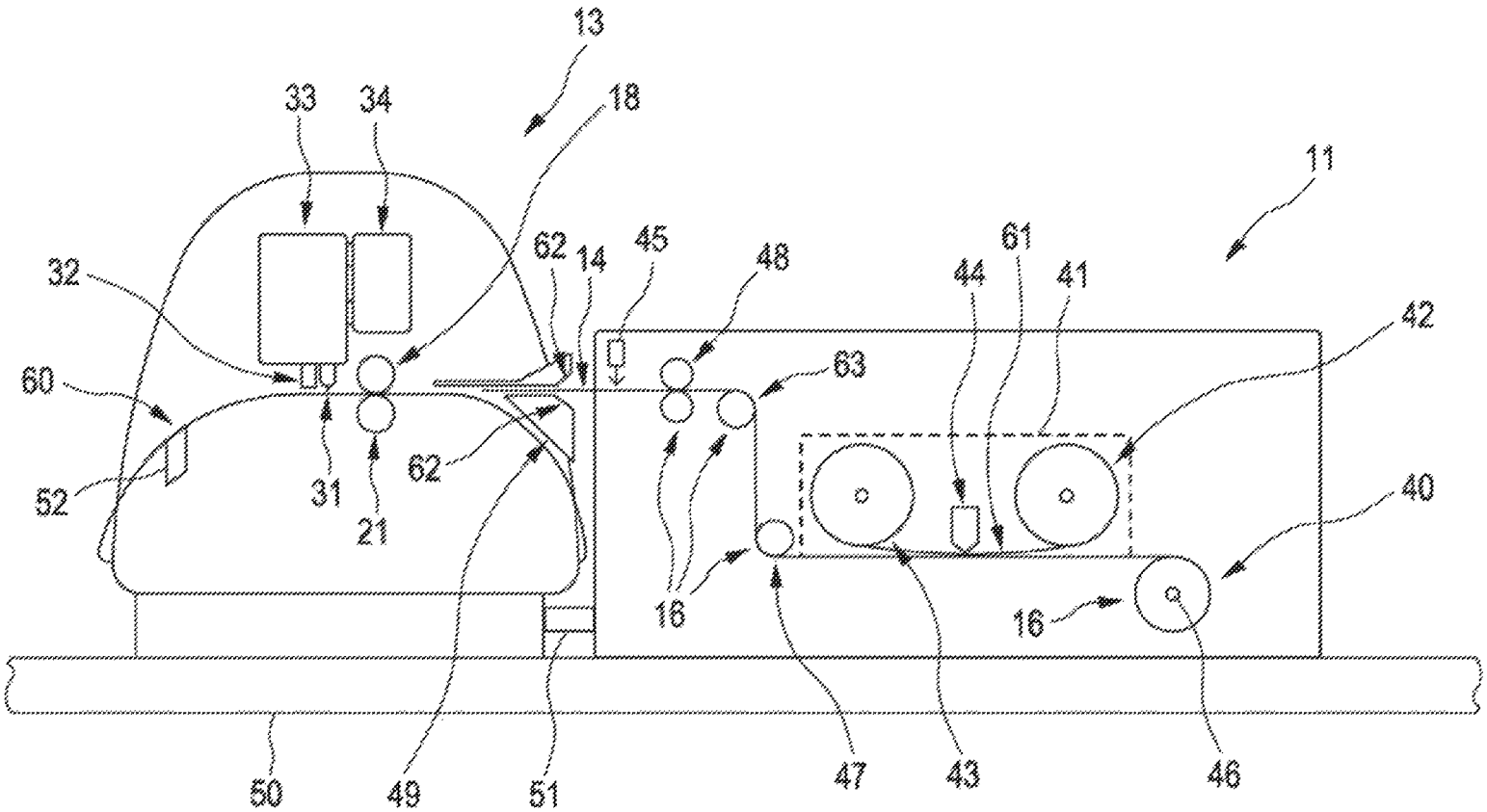
FIG. 4 shows, in schematic form and by way of example, a view of a combined printing means and cutting apparatus of the device shown in FIG. 1.

Details of printing means 11 and cutting apparatus 13 shall now be described with reference to FIG. 4. FIG. 4 is an abstract view that also shows elements of printing means 11 and cutting apparatus 13 which are basically not visible because they are arranged inside respective housings.

Printing means 11 has a plurality of rolls 46, 47, 48, 63, at least one of which is driven motorically to move printed adhesive film 14 in the first direction from printing means 11 to cutting apparatus 13. Rolls 46, 47, 48, 63 can therefore be conceived of as rolls of a first moving unit 16, which can move printed adhesive film 14 in the first direction from printing means 11 towards cutting apparatus 13. Printing means 11 further comprises a printing unit 41 for printing the adhesive film rolled off from roll of adhesive film 40, said roll of adhesive film 40 being mounted on roll 46 of the first moving unit 16. Printing unit 41 includes two ink ribbon rolls 42, 43 having an ink ribbon 61 and a thermal printing head 44. Thermal printing head 44, the adhesive film and ink ribbon 61 are moved in a way that the desired printing pattern is printed onto the adhesive film. Printing means 11 further comprises a cut-off unit 45 for cutting off printed adhesive film 14 after the latter has been fed into cutting apparatus 13 in such a way that it is held by the first moving unit 16, that is, by at least the rolls 48 of the first moving unit 16, and by the second moving unit 18, that is, by the rolls 21 of the second moving unit 18.

The first and the second moving units 16, 18 are typically controlled in such a way that only the first moving unit 16 is initially activated to move printed adhesive film 14 to the second moving unit 18, wherein both moving units 16, 18 are then activated in such a way that the two moving units 16, 18 move printed adhesive film 14 synchronously further into cutting apparatus 13. In this embodiment, controller 10, for example, is aware of the distance that printed adhesive film 14 is to be moved in the direction of cutting apparatus 13, so as to move printed adhesive film 14 to the second moving unit 14 such that printed adhesive film 14 is located directly in front of rolls 21 of the second moving unit 18. Based on this predefined distance, the first moving unit 16 can be controlled in such a way that printed adhesive film 14 is moved to the second moving unit 18 so that it is located directly in front of the rolls 21 of the second moving unit 18, both moving units 16, 18 then being activated in such a way that both moving units 16, 18 synchronously move printed adhesive film 14 further into cutting apparatus 13. Printed adhesive film 14 is typically moved to the second moving unit 18 by means of the first moving unit 16 at a maximum speed of the first moving unit 16. After printed adhesive film 14 has been moved forwards to the second moving unit 18 at the maximum speed of the first moving unit 16, the first moving unit 16 and the second moving unit 18 move printed adhesive film 14 synchronously at a second speed further into cutting apparatus 13. This second speed may be equal to the first speed at which the first moving unit 16 moved the printed adhesive film 14 to the second moving unit 18, or the second speed may differ from the first speed. The second speed is typically equal to the lower of the two maximum speeds of the first moving unit 16 and the second moving unit 18.

Controller 10 is typically configured to control printing means 11 such that, after printed adhesive film 14 has been moved in the first direction to the second moving unit 18 by means of the first moving unit 16, and after the second moving unit 18 has gripped printed adhesive film 14 for further movement, printed adhesive film 14 is cut off by means of cut-off unit 45.

This means that the printed adhesive film is typically moved initially a little in the forward direction by both moving units 16, 18, which move synchronously, so that the printed adhesive film is also held securely by the second moving unit 18 of cutting apparatus 13, after which cut-off unit 45 of printing means 11 cuts off the printed adhesive film. After that, the cut-off, printed adhesive film is moved further forwards, by means of second moving unit 18, as far as the detection unit 32 for detecting the orientation marking.

Printed adhesive film 14 has an orientation marking 17 which was printed onto adhesive film 14 by printing means 11. Cutting apparatus 13 includes a detection unit 32 for detecting the orientation marking on printed adhesive film 14, said cutting apparatus 13 being adapted to optimize the orientation of printed adhesive film 14 inside cutting apparatus 13, on the basis of the detected orientation marking 17, before cutting is carried out. More particularly, the second moving unit 18 for moving printed adhesive film 14 in a forward and a backward direction inside cutting apparatus 13, and a cutting unit 31 of cutting apparatus 13, which can be moved orthogonally in relation thereto, can be controlled in such a way that the position of the cutting unit relative to the orientation marking corresponds very accurately to a predefined position, before cutting along the cutting pattern is carried out.

In this embodiment, both cutting unit 31 and detection unit 32 are mounted on a same head 33 of cutting apparatus 13, wherein said head 33 can be moved orthogonally to the forward and the backward direction along an axis 34 by means of a motor. The second moving unit 18 moves printed adhesive film 14, and head 33 moves detection unit 32 in such a way that detection unit 32 is arranged above the inside corner 50 of orientation marking 17. Detection unit 32, in particular, includes a light source, for example a laser, and a light detector, for example a photodiode, wherein the second moving unit 18 moves printed adhesive film 14 in such a way, and head 33 with detection unit 32 is moved in such a way, that a beam of light emitted from the light source of detection unit 32 strikes the inside corner inside corner 50 of orientation marking 17. When this state is reached, cutting unit 31 has a defined, very exact orientation relative to printed adhesive film 14, in particular to the printing pattern. After that, cutting apparatus 13 is controlled so that adhesive film 14 is cut along the cutting pattern of the respective pattern 15, adhesive film 14 being on a substrate, in particular on a paper substrate or on some other substrate medium, and cutting apparatus 13 is typically adapted to cut through only adhesive film 14, but not the substrate underneath it. The adhesive labels produced by printing and cutting can then be outputted through output slot 7. The customer can pull an adhesive label from the adhesive film 14 that has been printed and cut and can stick the label onto the desired product.

In one embodiment, cutting apparatus 13 does not use a detection unit to detect an orientation marking on the printed adhesive film, so as to position the printed adhesive film and the cutting unit of cutting apparatus relative to each other. In this embodiment, it is preferable that the cutting apparatus does not have such a detection unit. In this embodiment, furthermore, the printing means may be configured not to print an orientation marking onto the printed adhesive film.

Cutting apparatus 13 has a guide structure 49 between second moving unit 18 and printing means 11, for guiding printed adhesive film 14 from printing means 11 to the second moving unit 18, said guide structure 49 having at least two converging surfaces 62. The two converging surfaces 62 are oriented in such a way that they guide printed adhesive film 14 towards an inlet slot of cutting apparatus 13, one of said converging surfaces 62 being arranged above the inlet slot and another one of said converging surfaces 62 being arranged below the inlet slot. The two converging surfaces 62 extend along the inlet slot, below and above the inlet slot.

The apparatus further comprises a guide mechanism 50, which in this embodiment is a rail system 50 for guiding relative movement between printing means 11 and cutting apparatus 13 along the first direction. Rail system 50 allows printing means 11 and cutting apparatus 13 to move apart and back together again in a guided manner. Moving them apart may make sense, for example, so as to make it easier to access cutting apparatus 13 and/or printing means 11, for example to carry out maintenance work such as replacing the ink ribbon rolls or the roll of adhesive film. In order to produce the printed, cut-off adhesive film which has been cut along the cutting pattern, printing means 11 and cutting apparatus 13 are pushed together. To ensure that printing means 11 and cutting apparatus 13 have a defined and known position relative to each other while the printed adhesive film is being produced, despite the possibility of relative movement, the apparatus includes a detection unit 51 which is designed to detect whether the printing means 11 and the cutting apparatus 13 have a predefined position relative to one another in the first direction. In this embodiment, detection unit 51 is a contact sensor which is mounted on cutting apparatus 13 in such a way that it is contacted by printing means 11 when cutting apparatus 13 and printing means 11 are positioned relative to each other in the predefined manner. The sensor can be a microswitch, for example. Some other detection unit may also be used, of course, comprising a separation diode, for example, or on that detects contact electrically and/or magnetically, etc.

Cutting apparatus 13 also comprises, in an output area 60 which may have a sloping area, for example, along which printed adhesive film 14 can slide out of said cutting apparatus 13, a release unit 52 for releasing the printed and cut adhesive film 14 from cutting apparatus 13, in particular from the surface in output area 60 of cutting apparatus 13. This release unit 52 may have a movable element, for example, such as a movable pin which can lift the printed and cut adhesive film 14 from the surface in order to release it from the surface. The element for lifting the printed and cut adhesive film 14 from the surface in output area 60 can be moved electrically and/or magnetically, for example. Release unit 52 may also be designed in some other way so as to release the respective printed and cut adhesive film 14 from the surface in output area 60 of cutting apparatus 13. It may make sense to release the printed and cut adhesive film 14 from the surface in output area 60 of cutting apparatus 13, because cutting the printed adhesive film 14 along the cutting pattern can cause the printed adhesive film 14 to become electrostatically charged, which in turn can cause the printed and cut adhesive film 14 to stick to the surface in output area 60 of cutting apparatus 13.

Figure 5:
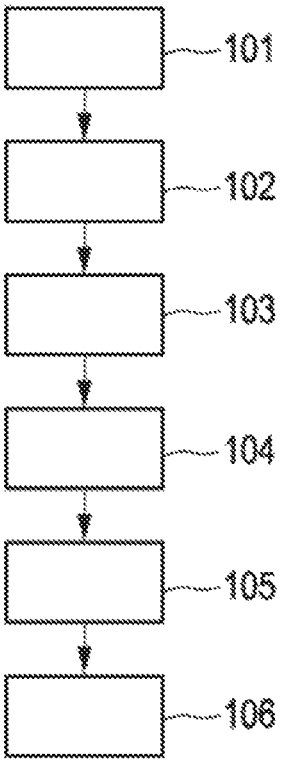
FIG. 5 shows a flow diagram illustrating an embodiment of a method for producing adhesive labels.

An embodiment of a method for producing adhesive labels, in particular in a self-service area, for example of a drug store, shall now be described with reference to a flow diagram shown in FIG. 5.

In step 101, a customer can enter inputs to input device 8. For example, the customer can enter photo data, texts, desired colors, etc. The customer can also select a desired pattern template from a number of such pattern templates, for example. This selection can also be made by selecting a product, with the customer firstly selecting a product, after which the customer can be shown one or more pattern templates that match the selected product. If the customer is shown several pattern templates, the customer can select one of those pattern templates by means of input device 8.

In step 102, a pattern is generated by pattern generating means 9 on the basis of the customer inputs, said pattern comprising a cutting pattern and a printing pattern within the cutting pattern. For example, a photo of the customer, included in the photo data, is integrated into a pattern template, and the pattern template can also be modified with colors and/or text entered by the customer in step 101. The pattern generated in this manner, that is the printing pattern at least, is sent to printing means 11, which prints the printing pattern onto the adhesive film in step 103.

In step 104, the printed adhesive film is transferred automatically from printing means 11 to cutting apparatus 13, with only the first moving unit 16 of printing means 11 initially moving the printed adhesive film at a first speed to the second moving unit 18 of cutting apparatus 13, after which the two moving units 16, 18 synchronously move printed adhesive film 14 further in the first direction into cutting apparatus 13. In step 105, cutting apparatus 13 cuts the adhesive film along the cutting pattern to produce the adhesive labels, and in step 106 the adhesive labels thus produced are outputted through output slot 7.

Input device 8 typically provides a graphical user interface, which can be operated by the customer by means of touch-sensitive monitor 3, for selecting desired colors, desired pattern templates, etc., and for entering desired texts. The adhesive label thus produced may be an adhesive label to be stuck onto a product to be bought, for example a shower gel container, muesli packaging, etc., in which case an adhesive label is produced which is suitable for the respective product, that is, for the respective product packaging. However, apparatus 1 may also be adapted to produce adhesive labels which are not specifically matched to particular products or product containers. This means that apparatus 1 may also be adapted to produce adhesive labels which are independent of specific products and which can be stuck onto cars or other objects, for example.

Apparatus 1 allows personalized adhesive labels to be produced, that is, adhesive labels which have been designed by means of customer inputs. In the embodiment described with reference to FIGS. 1 to 4, photo data receiving unit 5 is adapted to read photo data by means of a storage medium, for example, a USB flash drive. In other embodiments, however, the photo data receiving unit may also be adapted to receive the photo data in some another manner. For example, the photo data may be received directly from a camera via a wired or wireless data connection, in particular from a smartphone with a photo function. The photo data receiving unit may also be adapted to receive the photo data via cloud services such as Facebook, Dropbox, CEWE MYPHOTOS, etc.

The printing means, which is a dye-sublimation thermal printer, prints the respective pattern onto an adhesive film which is disposed on a substrate medium, for example a paper substrate, after which the printed adhesive film is transferred automatically to the cutting apparatus, which can also be conceived of as a sticker cutter. In one embodiment, an orientation marking applied to the adhesive film is detected by sensors, that is, by the detection unit of the cutting apparatus, and is used to re-adjust the adhesive film, that is, for vertical and horizontal alignment of the adhesive film. In addition to the printed adhesive film, a digital clipping mask, that is, the cutting pattern, is sent to the cutting apparatus, said digital clipping mask representing the outlines of the adhesive label. The cutting unit of the cutting apparatus typically comprises a drag knife, which is moved along the outline of the adhesive label, that is, along the cutting pattern, in order to cut into the adhesive film along the cutting pattern. The drag knife is typically moved in such a way that only the adhesive film is incised, but not the substrate medium.

The cutting apparatus may be adapted to cut out any cutting patterns that are offered to the customer in the form of templates, that is, in the form of the pattern templates, with the customer being able to select any one of those templates. After cutting, the cutting apparatus outputs the adhesive label that has finally been produced. The adhesive label can be pulled off the substrate material by the customer without any residue being left. If the customer selected a product to which he would like to apply the adhesive label, the latter can now be stuck on by the customer himself. Products obtainable in the drug store can thus be personalized in a simple manner by the customer himself.

Although the printing unit in the embodiments described above has a roll of adhesive film, it is also possible that the printing means prints single sheets of adhesive film, so there is no need for cutting. In that case, the printing means typically has no cut-off unit.

The words "comprise" and "include" do not exclude other elements or steps, and the indefinite article "a/an" does not exclude a plurality.

A single unit or device may perform the functions of several elements. The fact that individual functions and elements are mentioned in different dependent claims or separately does not mean that a combination of these functions or elements could not also be used.

Although a printing means having a specific number and arrangement of components has been described above, the printing means may also have a different number and/or arrangement of components. For example, the rolls for moving and guiding the adhesive film inside the printing means may be arranged differently. A different number of rollers may also be used. The printing unit, the roll of adhesive film and/or the cut-off unit can also be arranged differently. The components inside the printing means, i.e., the ink ribbon rolls and the thermal printing head, can also be arranged in a different way.

In one embodiment described above, the first moving unit initially moves the printed adhesive film to the second moving unit, after which both moving units synchronously move the printed adhesive film further forwards, such that both moving units securely grip the printed adhesive film, at which the forward movement is then stopped and the printed adhesive film is cut off by means of the cut-off unit. The printed adhesive film is then cut along the cutting pattern by moving the printed adhesive film back and forth using the second moving unit, and by moving the cutting apparatus back and forth accordingly. In another embodiment, cutting along the cutting pattern can be carried out before the printed adhesive film is cut off by means of the cut-off unit. In this case, the first moving unit is also moved forwards and backwards accordingly, for cutting along the cutting pattern. This means that, in order to cut along the cutting pattern, the first and second moving units are synchronously controlled in such a way that the printed adhesive film is moved backwards and forwards according to the cutting pattern. In one embodiment, for example, the printed adhesive film can firstly be moved by means of the first moving unit to the second moving unit, after which both moving units synchronously move the printed adhesive film further forwards as far as the detection unit for detecting the orientation marking. After that, and in order to cut along the cutting pattern, the first and second moving units can be synchronously controlled in such a way that the printed adhesive film is moved back and forth according to the cutting pattern, and the cutting unit of the cutting apparatus is controlled in such a way that the cutting unit typically moves orthogonally to the backward and forward direction, according to the cutting pattern. After cutting along the cutting pattern has been completed, the cut-off unit cuts off the printed and cut adhesive film.

The apparatus for producing self-adhesive labels can be controlled by means of a single controller or by a plurality of controllers. For example, cutting apparatus 13 and printing means 11 may have local controllers for controlling the individual components of cutting apparatus 13 and printing means 11, and these local controllers can communicate with a central controller which controls the local controllers of cutting apparatus 13 and printing means 11, or synchronizes the local controllers. It is also possible that the local control apparatuses communicate directly with each other, in which case it is possible that there is no central controller. The control functions described above can thus be realized by a single controller or by a plurality of controllers. The controller of the device for producing adhesive labels in accordance with the method for producing adhesive labels can be implemented as computer program code and/or in the form of appropriate hardware and in particular is a programmable logic controller (PLC).

A computer program can be stored and/or distributed on a suitable medium, for example on a non-transitory storage medium such as an optical storage medium or a solid-state storage medium which is operated in combination with or as part of other hardware. However, the computer program can also be distributed in other forms, for example via the Internet or other telecommunications systems.

The reference signs in the claims are not to be understood as meaning that the subject-matter and the extent of protection conferred by the claims is limited by these reference signs.

The present disclosure relates to an apparatus for producing self-adhesive labels, in particular in a self-service area, for example of a drug store. The apparatus comprises a dye-sublimation thermal printer, as a printing means for printing a printing pattern onto an adhesive film, and a cutting apparatus for cutting the adhesive film along a cutting pattern, the adhesive film being moved automatically from the printing means to the cutting apparatus. Initially, only a first moving unit of the printing means moves the adhesive film at a first speed to a second moving unit of the cutting apparatus, after which both moving units move the printed adhesive film further in the forward direction.

The invention claimed is:

1. An apparatus for producing self-adhesive labels, in a self-service area, using a thermal dye-sublimation process, the apparatus comprising:

a printing means configured to print a printing pattern onto an adhesive film using a thermal dye-sublimation process; and a cutting apparatus configured to cut the adhesive film along a cutting pattern, the printing means having a first moving unit for automatically moving the printed adhesive film from the printing means to the cutting apparatus in a first direction and the cutting apparatus has a second moving unit for moving the printed adhesive film in the first direction inside the cutting apparatus, the printing means and the cutting apparatus being configured such that only the first moving unit moves the printed adhesive film initially at a first speed to the second moving unit, after which both moving units move the printed adhesive film at a second speed in the first direction again and wherein the first speed and the second speed are different from one another and the first speed is greater than the second speed.

2. The apparatus according to claim 1, wherein the first moving unit has a maximum speed and the printing means is configured such that the first speed is a maximum speed.

3. The apparatus according to claim 1, wherein the printing means has a roll of adhesive film comprising the adhesive film and a cut-off unit for cutting the printed adhesive film so as to detach the printed adhesive film from the roll of adhesive film, the printing means being configured such that, after the printed adhesive film has been moved in the first direction to the second printing means by the first printing means, after the second moving unit has gripped the printed adhesive film for further movement, the printed adhesive film is cut off by the cut-off unit.

4. The apparatus according to claim 1, wherein the cutting apparatus has no detection unit for detecting an orientation marking on the printed adhesive film, which would be suitable for relative positioning of the printed adhesive film and a cutting unit of the cutting apparatus, and the printing means is configured not to print such an orientation marking onto the adhesive film.

5. The apparatus according to claim 1, wherein the cutting apparatus has a guide structure between the second moving unit and the printing means, configured to guide the printed adhesive film from the printing means to the second moving unit, the guide structure having at least two converging surfaces.

6. The apparatus according to claim 1, wherein the apparatus has a guide mechanism configured to guide a relative movement between the printing means and the cutting apparatus along the first direction.

7. The apparatus according to claim 6, wherein the apparatus has a detection unit that is designed to detect whether the printing means and the cutting apparatus have a predefined position relative to one another in the first direction.

8. The apparatus according to claim 7, wherein the printing means and the cutting apparatus are configured such that an adhesive film is only printed and moved in the first direction from the printing means to the cutting apparatus when the detection unit has detected that the printing means and the cutting apparatus have the predefined position relative to one another in the first direction.

9. The apparatus according to claim 1, wherein the cutting apparatus has a release unit configured to release the printed and cut adhesive film from the cutting apparatus.

10. The apparatus according to claim 1, wherein the second moving unit has motor-driven rolls with no freewheel.

11. A printing means for printing a printing pattern onto an adhesive film using a thermal dye-sublimation process, the printing means being adapted to be operated together with a cutting apparatus to produce adhesive labels in a self-service area, the printing means having a first moving unit for automatically moving the printed adhesive film from the printing means to the cutting apparatus in a first direction and the cutting apparatus having a second moving unit for moving the printed adhesive film in the first direction inside the cutting apparatus, the printing means being configured to firstly move the printed adhesive film only using the first moving unit at a first speed to the second moving unit and then to move the printed adhesive film into the cutting apparatus at a second speed in the first direction using the first moving unit acting jointly with the second moving unit, wherein the first speed and the second speed are different from one another and the first speed is greater than the second speed.

12. A cutting apparatus for cutting an adhesive film along a cutting pattern, the cutting apparatus being adapted to be operated together with the printing means of claim 11 to produce adhesive labels using a thermal dye-sublimation process in a self-service area, the printing means having a first moving unit for automatically moving the printed adhesive film from the printing means to the cutting apparatus in a first direction and the cutting apparatus has a second moving unit for moving the printed adhesive film in the first direction inside the cutting apparatus, the cutting apparatus being configured to move the printed adhesive film into the cutting apparatus at a second speed in the first direction using the second moving unit acting jointly with the first moving unit, after only the first moving unit has initially moved the printed adhesive film at a first speed in the first direction to the second moving unit, wherein the first speed and the second speed are different from one another and the first speed is greater than the second speed.

13. A method for producing adhesive labels using a thermal dye-sublimation process in a self-service area, the method comprising the steps of:

printing a printing pattern onto an adhesive film using a printing means that uses a thermal dye-sublimation process;

automatically moving the printed adhesive film from the printing means to a cutting apparatus in a first direction using a first moving unit of the printing means and automatically moving the printed adhesive film in the first direction inside the cutting apparatus using a second moving unit of the cutting apparatus, wherein only the first moving unit moves the printed adhesive film initially at a first speed to the second moving unit, after which both moving units move the printed adhesive film at a second speed in the first direction again, and wherein the first speed and the second speed are different from one another and the first speed is greater than the second speed; and cutting the adhesive film along a cutting pattern using the cutting apparatus.

14. A non-transitory storage medium containing computer program code which is configured, when executed by a controller, to control a device to produce adhesive labels by performing a method comprising:

printing a printing pattern onto an adhesive film using a printing means that uses a thermal dye-sublimation process;

automatically moving the printed adhesive film from the printing means to a cutting apparatus in a first direction using a first moving unit of the printing means and automatically moving the printed adhesive film in the first direction inside the cutting apparatus using a second moving unit of the cutting apparatus, wherein only the first moving unit moves the printed adhesive film initially at a first speed to the second moving unit, after which both moving units move the printed adhesive film at a second speed in the first direction again, and wherein the first speed and the second speed are different from one another and the first speed is greater than the second speed; and cutting the adhesive film along a cutting pattern using the cutting apparatus.

* * * * *